United States Patent [19]

Jongenburger

[11] Patent Number: 4,995,922

[45] Date of Patent: Feb. 26, 1991

[54] OXIDE-DISPERSION-HARDENED SUPERALLOY BASED ON NICKEL

[75] Inventor: Peter Jongenburger, Baden, Switzerland

[73] Assignee: Asea Brown Boveri Ltd., Baden, Switzerland

[21] Appl. No.: 295,559

[22] Filed: Jan. 11, 1989

[30] Foreign Application Priority Data

Jan. 18, 1988 [CH] Switzerland ..... 159/88

[51] Int. Cl.[5] ..... C22C 19/05

[52] U.S. Cl. ..... 148/428; 148/11.5 N; 420/443

[58] Field of Search ..... 148/410, 11.5 N, 428; 420/443

[56] References Cited

U.S. PATENT DOCUMENTS 4,386,976 6/1983 Benn et al. ..... 148/428
4,668,312 5/1987 Benn et al. ..... 148/428

FOREIGN PATENT DOCUMENTS 2353971 5/1974 Fed. Rep. of Germany .
2463066 7/1984 Fed. Rep. of Germany .
2204700 5/1974 France .

OTHER PUBLICATIONS

G. H. Gessinger, Powder Metallurgy of Superalloys, Butterworths London, 1984.
R. F. Singer, et al., Conf. Proc., "High Temperature Materials for Gas Turbines", Liege, Belgium, Oct. 1986, pp. 1-30.
J. S. Benjamin, Metallurgical Transactions, vol. 1, Oct. 1970, pp. 2943-2951.
K. Mino, et al., Transaction of the Iron and Steel Institute of Japan, vol. 27, pp. 823-829, Tokyo, 1987.
M. A. Burke, et al., Scripta Metallurgica, vol. 18, pp. 91-94, Pergamon 1984.

*Primary Examiner*—R. Dean
*Attorney, Agent, or Firm*—Oblon, Spivak, McClelland, Maier & Neustadt

[57] ABSTRACT

Oxide-dispersion-hardened superalloy based on nickel, which is composed of the following main constituents:

| | | |
|---|---|---|
| Cr = | 5-13.95 | percent by weight or |
| | 14.05-22 | percent by weight |
| Al = | 2.5-7 | percent by weight |
| Mo = | 0-2 | percent by weight |
| W = | 0-15 | percent by weight |
| Ta = | 0-7 | percent by weight |
| Hf = | 0-1 | percent by weight |
| Ti = | 0-3 | percent by weight |
| Zr = | 0.02-0.2 | percent by weight |
| Co = | 0-10 | percent by weight |
| C = | 0-0.2 | percent by weight |
| $Y_2O_3$ = | 1-2 | percent by weight |
| Ni = | Remainder. | |

and which additionally contains boron in a content of 0.026 to 0.3 percent by weight.

A process for extending the temperature range of the secondary recrystallization of an oxide-dispersion-hardened nickel-base superalloy of the above composition during coarse-grain annealing and during the production of a monocrystal with a cross section of at least 5 $cm^2$ by doping with a boron content of at least 0.011 percent by weight.

19 Claims, 4 Drawing Sheets

OXIDE-DISPERSION-HARDENED SUPERALLOY BASED ON NICKEL

BACKGROUND OF THE INVENTION

Field of the Invention

Oxide-dispersion-hardened superalloys based on nickel which, owing to their outstanding mechanical properties at high temperatures, are used in the construction of heat engines subjected to high thermal and mechanical loads. Preferred use as bucket materials for gas turbines.

The invention relates to the further development of oxide-dispersion-hardened nickel-base superalloys with overall optimal properties, in particular, in relation to behavior during the secondary recrystallization to achieve a coarse-grain structure and to produce monocrystals of large dimensions.

In particular, it relates to an oxide-dispersion-hardened superalloy based on nickel which is composed of the following main constituents:

| | |
|---|---|
| Cr = | 5-13.95 percent by weight or 14.05-22 percent by weight |
| Al = | 2.5-7 percent by weight |
| Mo = | 0-2 percent by weight |
| W = | 0-15 percent by weight |
| Ta = | 0-7 percent by weight |
| Hf = | 0-1 percent by weight |
| Ti = | 0-3 percent by weight |
| Zr = | 0.02-0.2 percent by weight |
| Co = | 0-10 percent by weight |
| C = | 0-0.2 percent by weight |
| $Y_2O_3$ = | 1-2 percent by weight |
| Ni = | Remainder. |

It further relates to a process for extending the temperature range of the secondary recrystallization of an oxide-dispersion-hardened nickel-base superalloy during coarse-grain annealing of a workpiece and during annealing to produce a monocrystal of large dimensions having a cross section of at least 5 $cm^2$.

Discussion of Background

The following literature is cited in relation to the general prior art:

G. H. Gessinger, Powder Metallurgy of Superalloys, Butterworths, London, 1984

R. F. Singer and E. Arzt, Conf. Proc. "High Temperature Materials for Gas Turbines", Liège, Belgium, October 1986

J. S. Benjamin, Metall. Trans., 1970, 1, 2943-2951.

In the course of past years, a new class of high-temperature superalloys have been developed, in particular, for components of heat engines (gas-turbine buckets). These are nickel-base alloys which contain finely divided dispersoides in the form of oxides. In the case of the latter, these are usually $Y_2O_3$ particles. The alloys are used in the state of coarse-grain columnar crystals aligned in the longitudinal axis of the component. The coarser the crystals, the better the mechanical high-temperature properties (resistance to a creep and fatigue strength for comparatively low endurance etc.). An attempt is made to achieve the desired structural condition by a process of annealing the forged, hot-pressed or usually extruded, fine-grain semi finished product, "zone annealing" playing a dominating role. In the latter, the workpiece is heated zone-by-zone for a short time above the recrystallization temperature, it being necessary to achieve as high a temperature/path gradient as possible during heating up. This applies to the entire cross section of the workpiece. This requirement encounters difficulties in the case of large cross sections owing to the transverse heat flow it necessitates. There is, in fact, only the temperature range between recrystallization temperature and solidus temperature (appearance of the first liquid phase) available as a "window" for carrying out the annealing process. In the conventional, commercially available oxide-dispersion-hardened nickel-base superalloys, this range is comparatively narrow and is inadequate for converting workpieces of large cross section successfully to coarse grain and, in the ideal case, into a monocrystal.

There is therefore an extreme need to improve the recrystallization conditions of oxide-dispersion-hardened superalloys, in particular, for greater freedom in the choice of working parameters for a coarse-grain annealing and for annealing to produce monocrystals of large dimensions.

As the prior art and as an example of a known conventional precipitation-hardenable, oxide-dispersion-strengthened nickel-base superalloy, mention is made of the alloy with the trade designation MA6000 produced by INCO (cf. DE-A-No. 2,353,971). Corresponding alloys are furthermore known with a comparatively low chromium content (cf. K. Mino and K. Asakawa, "An oxide dispersion strengthened nickel-base superalloy with excellent high temperature strength", Transactions of the Iron and Steel Institute of Japan, vol. 27, pages 823-829, Tokyo, 1987).

It has already been proposed that the mechanical and thermal properties at medium and high temperatures, in particular, the ductility and the resistance to thermal fatigue (fatigue for comparatively low endurance) should be improved, in the case of conventional, non-oxide-dispersion-hardened nickel-base superalloys, by adding boron and carbon (cf. DE-A-No. 2,463,066; M. A. Burke, J. Greggi, G. A. Whitlow, The effect of boron and carbon on the microstructural chemistries of two wrought nickel base superalloys, Scripta metallurgica, vol. 18, pages 91-94, Pergamon 1984). However, there are no references whatsoever to oxide-dispersion-hardened superalloys. In addition, the mechanism of the recrystallization in the latter (so-called secondary recrystallization) is a completely different one to that of conventional alloys owing to the presence of non-coherent oxidic dispersoides.

SUMMARY OF THE INVENTION

Accordingly, one object of this invention is to provide novel, oxide-dispersion-hardened superalloys based on nickel which have an extended range of the temperature limits, compared with known alloys, for carrying out the annealing necessary for the production of coarse grain (secondary recrystallization). The object is, in particular, to provide a process for extending the temperature range of the secondary recrystallization which makes it possible to produce even monocrystals of large dimensions (cross section at least 5 $cm^2$) by suitable annealing processes (for example, "zone annealing").

This object is achieved by a superalloy based on nickel as mentioned in the introduction which additionally contains boron in a content of 0.026 to 0.3 percent by weight.

This object is further achieved by a process as mentioned in the introduction, which comprises doping the oxide-dispersion-hardened nickel-base superalloy with a boron content of more than 0.011 percent by weight.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 shows a diagram of the variation of the recrystallization temperature and of the solidus temperature as a function of the boron content of an oxide-dispersion-hardened nickel-base superalloy containing 15 percent by weight of chromium. 1 is the curve for the variation of the recrystallization temperature, while 2 is the curve for the variation of the solidus temperature. $\Delta T$ is the maximum temperature range available for the secondary recrystallization. Below curve 1, no recrystallization takes place and an annealing with the object of growing coarse grain or even a monocrystal is pointless. Above curve 2, liquid phases occur and the unity of the crystals is destroyed. The dispersoides agglomerate and become ineffective as a hardening agent. According to curve 2, although the solidus temperature decreases slightly as the boron content increases, the recrystallization temperature according to curve 1 decreases considerably more markedly, as a result of which $\Delta T$ is extended.

FIG. 2 shows a diagram of the variation of the recrystallization temperature and of the solidus temperature as a function of the boron content of an oxide-dispersion-hardened nickel-base superalloy containing 20 percent by weight of chromium. 3 is the curve for the recrystallization temperature, which falls off relatively steeply with increasing boron content, while 4 is the curve for the solidus temperature which has a substantially flatter variation. For a boron content of 0.03 percent by weight, the temperature range $\Delta T$ is already approx. 150° C.

FIG. 3 relates to a diagram of the variation of the recrystallization temperature and of the solidus temperature as a function of the boron content of an oxide-dispersion-hardened nickel-base superalloy containing 17 percent by weight of chromium. 5 is the curve for the variation of the recrystallization temperature, while 6 is that for the variation of the solidus temperature. For a boron content of 0.035 percent by weight, the temperature range $\Delta T$ is approx. 145° C.

FIG. 4 shows a diagram of the variation of the recrystallization temperature and of the solidus temperature as a function of the boron content of an oxide-dispersion-hardened nickel-base superalloy with low chromium content. In the present case the latter was approx. 6 percent by weight. 7 is the curve for the variation of the recrystallization temperature, while 8 is the curve for the variation of the solidus temperature. For a boron content of 0.04 percent by weight, the temperature range $\Delta T$ is approx. 140° C.

It was possible to observe that, in all the oxide-dispersion-hardened nickel-base superalloy investigated, the temperature of the secondary recrystallization is decreased with increasing boron content. The magnitude of the effect of adding boron is variable and depends on the composition of the alloy. Apparently the chromium content plays an important role in this connection. In the case of alloys with a high chromium content, it was possible to detect a decrease in the recrystallization temperature of up to 50° C. per 0.01 percent by weight of boron added.

DESCRIPTION OF THE PREFERRED EMBODIMENTS

EXEMPLARY EMBODIMENT 1

Figure 1:
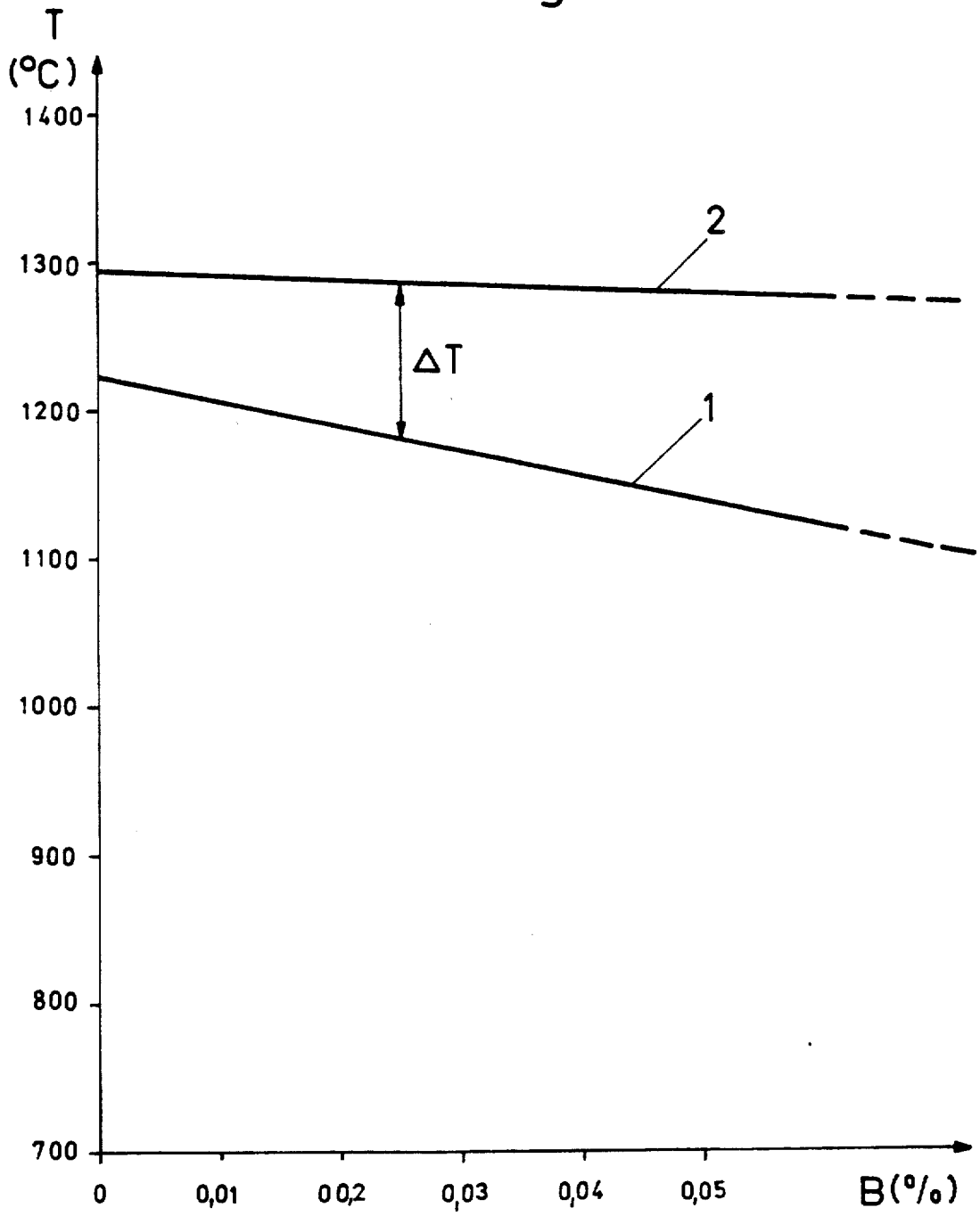
FIG. 1 shows a diagram of the variation of the recrystallization temperature and of the solidus temperature as a function of the boron content of an oxide-dispersion-hardened nickel-base superalloy containing 15 percent by weight of chromium.

Referring now to FIG. 1, a fine-grain oxide-dispersion-hardened nickel-base superalloy which was extruded in the delivered state was investigated. The boron-free alloy had the following basic composition:

| | |
|---|---|
| Cr = | 15 percent by weight |
| W = | 4.0 percent by weight |
| Mo = | 2.0 percent by weight |
| Al = | 4.5 percent by weight |
| Ti = | 2.5 percent by weight |
| Ta = | 2.0 percent by weight |
| C = | 0.05 percent by weight |
| Zr = | 0.15 percent by weight |
| $Y_2O_3$ = | 1.1 percent by weight |
| Ni = | Remainder. |

Samples with different boron additions were produced, the total boron content being varied between 0 and approx. 0.05 percent by weight. The recrystallization temperature and solidus temperature were determined by conventional methods. The results are shown graphically in FIG. 1.

A prismatic body made from the above material containing 0.04 percent by weight of boron and having a thickness of 20 mm, a width of 50 mm and a length of 180 mm were subjected to a zone annealing process. It was possible to obtain longitudinally directed columnar crystals with, on average, a width of 25 mm, a thickness of 8 mm and a length of 60 mm.

EXEMPLARY EMBODIMENT 2

Figure 2:
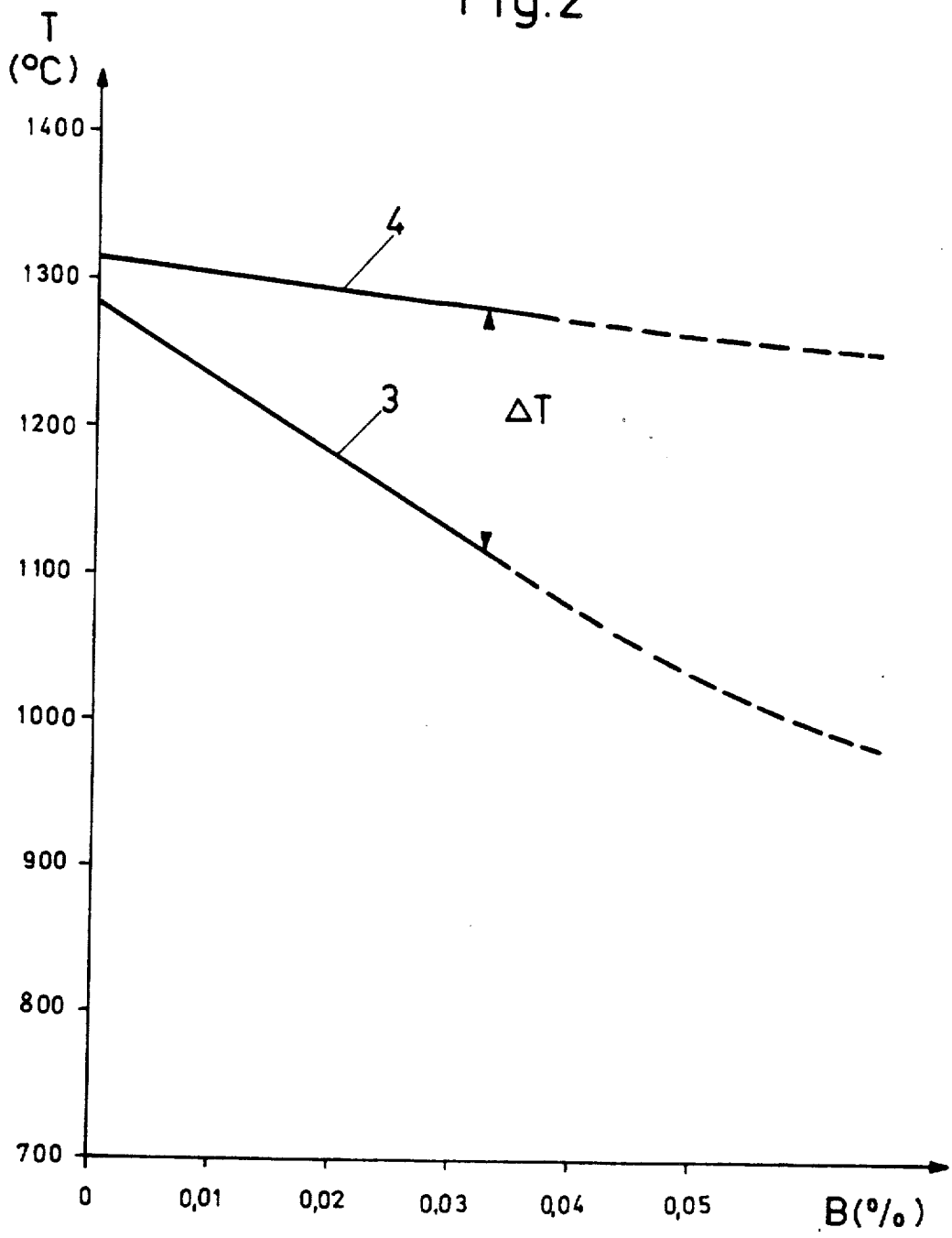
FIG. 2 shows a diagram of the variation of the recrystallization temperature and of the solidus temperature as a function of the boron content of an oxide-dispersion-hardened nickel-base superalloy containing 20 percent by weight of chromium.

Referring to FIG. 2, the investigation related to a fine-grain oxide-dispersion-hardened nickel-base superalloy which was extruded in the delivered state. The boron-free alloy had the following basic composition:

| | |
|---|---|
| Cr = | 20.0 percent by weight |
| Al = | 6.0 percent by weight |
| Mo = | 2.0 percent by weight |
| W = | 3.5 percent by weight |

-continued

| | |
|---|---|
| Zr = | 0.19 percent by weight |
| C = | 0.01 percent by weight |
| $Y_2O_3$ = | 1.1 percent by weight |
| Ni = | Remainder. |

Test bodies with systematically increasing boron contents were produced, the boron values being varied between 0 and approx. 0.045 percent by weight. Both the recrystallization temperature and the solidus temperature were determined by conventional methods. FIG. 2 shows the results obtained in the process.

An aerofoil section with the following dimensions was machined from the above material containing 0.03 percent by weight of boron:

| | |
|---|---|
| Width = | 92 mm |
| Maximum thickness = | 22 mm |
| Section height = | 26 mm |
| Length = | 240 mm |

The workpiece was subjected to a zone annealing process, and a monocrystal was produced.

EXEMPLARY EMBODIMENT 3

Figure 3:
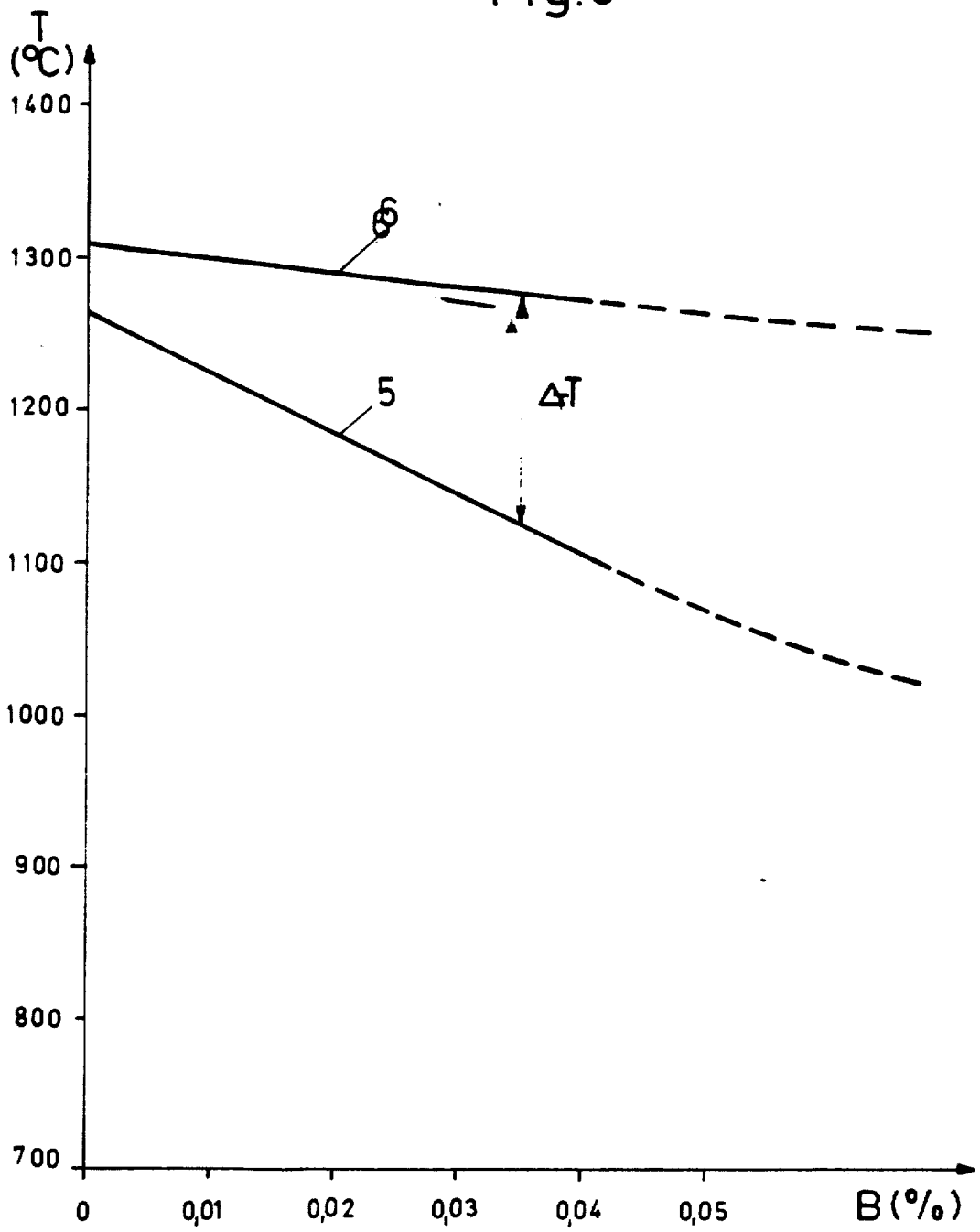
FIG. 3 shows a diagram of the variation of the recrystallization temperature and of the solidus temperature as a function of the boron content of an oxide-dispersion-hardened nickel-base superalloy containing 17 percent by weight of chromium.

Referring to FIG. 3, a fine-grain oxide-dispersion-hardened nickel-base superalloy which was extruded in the delivered state was subjected to testing. The boron-free alloy had the following basic composition:

| | |
|---|---|
| Cr = | 17.0 percent by weight |
| Al = | 6.0 percent by weight |
| Mo = | 2.0 percent by weight |
| W = | 3.5 percent by weight |
| Ta = | 2.0 percent by weight |
| Zr = | 0.15 percent by weight |
| C = | 0.05 percent by weight |
| $Y_2O_3$ = | 1.1 percent by weight |
| Ni = | Remainder. |

Samples were prepared with different boron additions, the total boron content being varied between 0.005 and 0.05 percent by weight. The solidus temperature and the recrystallization temperature were each determined by usual known methods. The results are shown in FIG. 3.

A cylindrical body with a diameter of 40 mm and a length of 200 mm was machined from the above material containing 0.035 percent by weight of boron and subjected to a zone annealing process. The recrystallized structure was composed of longitudinally directed columnar crystals with, on average, a thickness on all sides of 10 mm and a length of 130 mm.

EXEMPLARY EMBODIMENT 4

Figure 4:
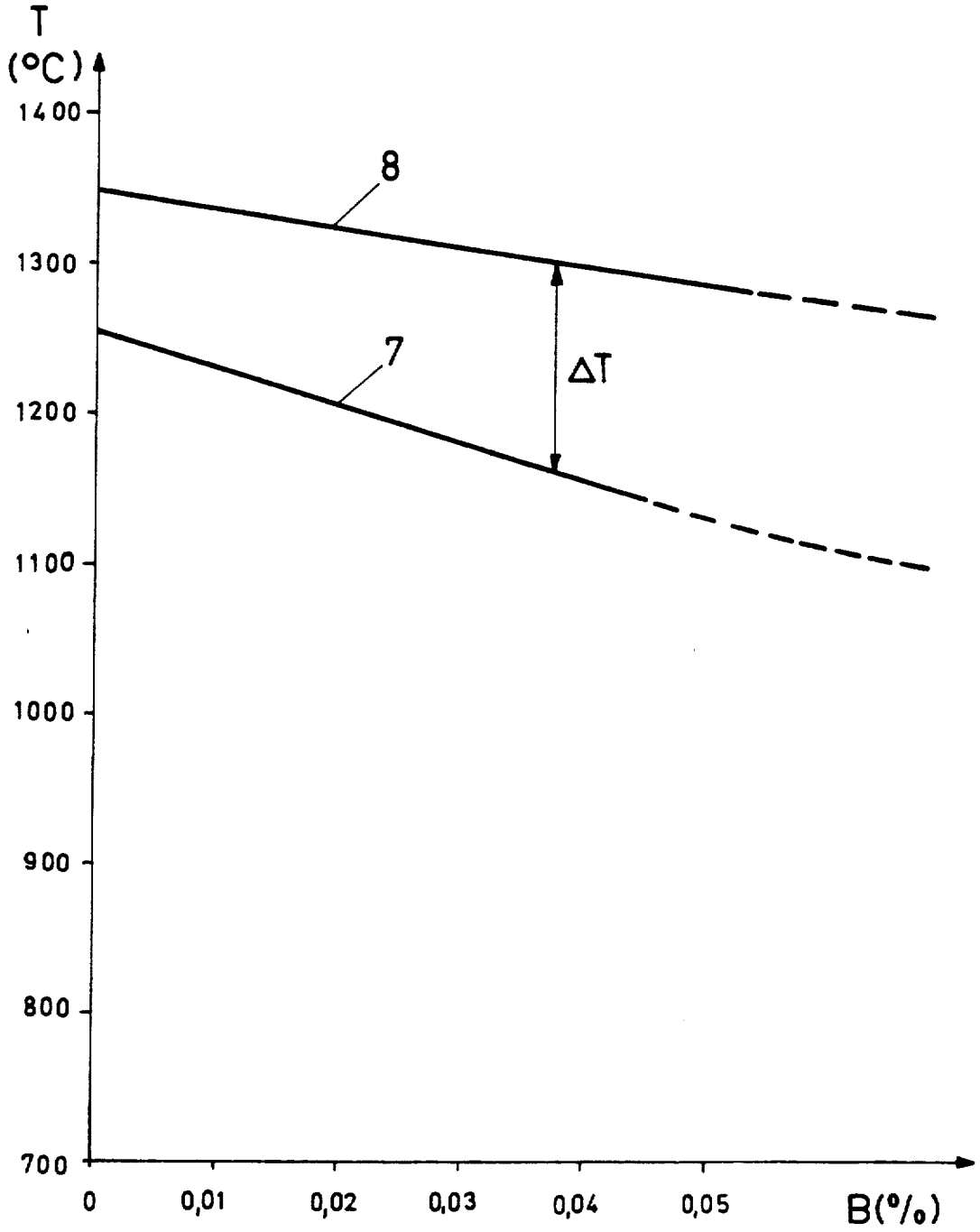
FIG. 4 shows a diagram of the variation of the recrystallization temperature and of the solidus temperature as a function of the boron content of an oxide-dispersion-hardened nickel-base superalloy with low chromium content.

Referring to FIG. 4, a fine-grain oxide-despersion-hardened nickel-base superalloy having a band structure which was hot-wrought in the delivered state was investigated. The alloy had the following basic composition:

| | |
|---|---|
| Co = | 9.7 percent by weight |
| Cr = | 5.9 percent by weight |
| Al = | 4.2 percent by weight |
| Mo = | 2.0 percent by weight |
| W = | 12.4 percent by weight |
| Ta = | 4.7 percent by weight |
| Ti = | 0.8 percent by weight |

-continued

| | |
|---|---|
| Zr = | 0.05 percent by weight |
| C = | 0.05 percent by weight |
| $Y_2O_3$ = | 1.1 percent by weight |
| Ni = | Remainder. |

Various contents of boron whose values ranged between 0.001 and 0.06 percent by weight were alloyed with the alloy of the basic composition. Both the solidus temperature and the recrystallization temperature were determined by the usual conventional methods. The results are shown graphically in FIG. 4.

A semi cylindrical body with a diameter of 55 mm and a length of 220 mm was machined from the above material containing 0.045 percent by weight of boron. The workpiece was subjected to a zone annealing process, a monocrystal being produced.

Obviously, numerous modifications and variations of the present invention are possible in the light of the above teachings. It is therefore to be understood that within the scope of the appended claims, the invention may be practiced otherwise than as specifically described herein and that the invention is not restricted to the exemplary embodiments.

The composition of the oxide-dispersion-hardened superalloys is as follows:

| | |
|---|---|
| Cr = | 5-13.95 percent by weight |
| Al = | 2.5-7 percent by weight |
| Mo = | 0-2 percent by weight |
| W = | 0-15 percent by weight |
| Ta = | 0-7 percent by weight |
| Hf = | 0-1 percent by weight |
| Ti = | 0-3 percent by weight |
| Zr = | 0.02-0.2 percent by weight |
| Co = | 0-10 percent by weight |
| C = | 0-0.2 percent by weight |
| $Y_2O_3$ = | 1-2 percent by weight |
| Ni = | Remainder, |

and also 0.026 to 0.3 percent by weight of boron or 0.026 to 0.1 percent by weight of boron.

Also:

| | |
|---|---|
| Cr = | 14.05-22 percent by weight |
| Al = | 2.5-7 percent by weight |
| Mo = | 0-2 percent by weight |
| W = | 0-15 percent by weight |
| Ta = | 0-7 percent by weight |
| Hf = | 0-1 percent by weight |
| Ti = | 0-3 percent by weight |
| Zr = | 0.02-0.2 percent by weight |
| Co = | 0-10 percent by weight |
| C = | 0-0.2 percent by weight |
| $Y_2O_3$ = | 1-2 percent by weight |
| Ni = | Remainder, |

and also 0.026 to 0.3 percent by weight of boron or 0.026 to 0.1 percent by weight of boron.

The following alloy furthermore also falls within the claimed composition:

| | |
|---|---|
| Cr = | 18-22 percent by weight |
| Al = | 5-7 percent by weight |
| Mo = | 0-4 percent by weight |
| W = | 2-5 percent by weight |
| Zr = | 0.1-0.2 percent by weight |
| C = | 0-0.2 percent by weight |
| $Y_2O_3$ = | 1-2 percent by weight |

-continued

| | |
|---|---|
| Ni = | Remainder. |

and also 0.011 to 0.3 percent by weight of boron or 0.011 to 0.1 percent by weight of boron.

A further class of alloy has the following composition:

| | |
|---|---|
| Cr = | 16–18 percent by weight |
| Al = | 6–7 percent by weight |
| Mo = | 2–2.5 percent by weight |
| W = | 3–3.5 percent by weight |
| Ta = | 2–2.5 percent by weight |
| Hf = | 0–1.5 percent by weight |
| Zr < | 0.2 percent by weight |
| C < | 0.1 percent by weight |
| $Y_2O_3$ = | 1–1.5 percent by weight |
| Ni = | Remainder. |

and also 0.02 to 0.3 percent by weight of boron or 0.02 to 0.1 percent by weight of boron.

The following type of alloy is furthermore claimed:

| | |
|---|---|
| Cr = | 16–18 percent by weight |
| Al = | 6–7 percent by weight |
| Co = | 8–10 percent by weight |
| Ta = | 5–7 percent by weight |
| Zr < | 0.2 percent by weight |
| C < | 0.1 percent by weight |
| $Y_2O_3$ = | 1–1.5 percent by weight |
| Ni = | Remainder, |

and also 0:02 to 0.3 percent by weight of boron or 0.02 to 0.1 percent by weight of boron.

Among the alloys with lower chromium content, the following are claimed:

| | |
|---|---|
| Co = | 0–10 percent by weight |
| Cr = | 5–17 percent by weight |
| Al = | 2.5–7 percent by weight |
| Mo = | 0–2 percent by weight |
| W = | 2.5–13 percent by weight |
| Ta = | 0–7 percent by weight |
| Ti = | 0.5–1.9 percent by weight |
| Zr = | 0.02–0.1 percent by weight |
| C = | 0–0.2 percent by weight |
| $Y_2O_3$ = | 1–2 percent by weight |
| Ni = | Remainder, |

and also 0.011 to 0.3 percent by weight of boron or 0.011 to 0.1 percent by weight of boron.

Preferably, the alloy mentioned has the following composition:

| | |
|---|---|
| Cr = | 13–17 percent by weight |
| Al = | 2.5–7 percent by weight |
| Mo = | 1–1.7 percent by weight |
| W = | 2.5–3.4 percent by weight |
| Ta = | 0–5 percent by weight |
| Ti = | 1–1.9 percent by weight |
| Zr = | 0.02–0.1 percent by weight |
| C = | 0–0.2 percent by weight |
| $Y_2O_3$ = | 1–2 percent by weight |
| Ni = | Remainder, |

and also 0.011 to 0.3 percent by weight of boron or 0.011 to 0.1 percent by weight of boron.

A specific advantageous selection is represented by the following composition:

| | |
|---|---|
| Cr = | 15 percent by weight |
| Al = | 5 percent by weight |
| Mo = | 1.7 percent by weight |
| W = | 3.4 percent by weight |
| Ta = | 4.5 percent by weight |
| Ti = | 1.9 percent by weight |
| Zr = | 0.1 percent by weight |
| C = | 0.05 percent by weight |
| $Y_2O_3$ = | 1.1 percent by weight |
| Ni = | Remainder. |

and also 0.011 to 0.3 percent by weight of boron or 0.011 to 0.1 percent by weight of boron.

The novel process relates to the extension of the temperature range of the secondary recrystallization of an oxide-dispersion-hardened nickel-base superalloy during coarse-grain annealing of a workpiece and during annealing to produce a monocrystal of large dimensions having a cross section of at least 10 $cm^2$, the oxide-dispersion-hardened nickel-base superalloy being doped with a boron content of more than 0.011 percent by weight. The doping is preferably 0.026 to 0.3 percent by weight of boron or 0.026 to 0.1 percent by weight of boron.

The advantages of the claimed alloys and of the novel process are in the greater freedom of the annealing process, in particular, of the zone annealing process, produced by extending the temperature range of the secondary recrystallization. This makes possible for the very first time the complete, satisfactory recrystallization to form coarse, longitudinally directed columnar crystals in the case of large workpiece cross sections to be treated. This is even more so for the annealing of a workpiece to produce a monocrystal of large dimensions. The novel process provides the possibility of producing turbine buckets of large cross section composed of a monocrystal, such as are required for modern industrial gas turbines of high power.

What is claimed as new and desired to be secured by Letters Patent of the United States is:

1. An oxide-dispersion-hardened superalloy based on nickel which is composed of the following main constituents:

| | |
|---|---|
| Cr = | 5–13.95 percent by weight |
| Al = | 2.5–7 percent by weight |
| Mo = | 0–2 percent by weight |
| W = | 0–15 percent by weight |
| Ta = | 0–7 percent by weight |
| Hf = | 0–1 percent by weight |
| Ti = | 0–3 percent by weight |
| Zr = | 0.02–0.2 percent by weight |
| Co = | 0–10 percent by weight |
| C = | 0–0.2 percent by weight |
| $Y_2O_3$ = | 1–2 percent by weight |
| Ni = | Remainder. |

which additionally contains boron in a content of 0.026 to 0.3 percent by weight.

2. An oxide-dispersion-hardened superalloy as claimed in claim 1, which contains boron in a content of 0.026 to 0.1 percent by weight.

3. An oxide-dispersion-hardened superalloy based on nickel, which consists essentially of:

| | |
|---|---|
| Cr = | 18–22 percent by weight |
| Al = | 5–7 percent by weight |
| Mo = | 0–4 percent by weight |

-continued

| | |
|---|---|
| W = | 2-5 percent by weight |
| Zr = | 0.1-0.2 percent by weight |
| B = | 0.011-0.3 percent by weight |
| C = | 0-0.2 percent by weight |
| $Y_2O_3$ = | 1-2 percent by weight |
| Ni = | Remainder. |

4. An oxide-dispersion-hardened superalloy as claimed in claim 3, which contains boron in a content of 0.011 to 0.1 percent by weight.

5. An oxide-dispersion-hardened superalloy based on nickel, which consists essentially of:

| | |
|---|---|
| Cr = | 16-18 percent by weight |
| Al = | 6-7 percent by weight |
| Mo = | 2-2.5 percent by weight |
| W = | 3-3.5 percent by weight |
| Ta = | 2-2.5 percent by weight |
| Hf = | 0-1.5 percent by weight |
| Zr < | 0.2 percent by weight |
| B = | 0.02-0.3 percent by weight |
| C < | 0.1 percent by weight |
| $Y_2O_3$ = | 1-1.5 percent by weight |
| Ni = | Remainder. |

6. An oxide-dispersion-hardened superalloy as claimed in claim 5, which contains boron in a content of 0.02 to 0.1 percent by weight.

7. An oxide-dispersion-hardened superalloy based on nickel, which consists essentially of:

| | |
|---|---|
| Cr = | 16-18 percent by weight |
| Al = | 6-7 percent by weight |
| Co = | 8-10 percent by weight |
| Ta = | 5-7 percent by weight |
| Zr < | 0.2 percent by weight |
| B = | 0.02-0.3 percent by weight |
| C < | 0.1 percent by weight |
| $Y_2O_3$ = | 1-1.5 percent by weight |
| Ni = | Remainder. |

8. An oxide-dispersion-hardened superalloy as claimed in claim 7, which contains boron in a content of 0.02 to 0.1 percent by weight.

9. An oxide-dispersion-hardened superalloy based on nickel which consists essentially of:

| | |
|---|---|
| Co = | 0-10 percent by weight |
| Cr = | 5-17 percent by weight |
| Al = | 2.5-7 percent by weight |
| Mo = | 0-2 percent by weight |
| W = | 2.5-13 percent by weight |
| Ta = | 0-7 percent by weight |
| Ti = | 0.5-1.9 percent by weight |
| Zr = | 0.02-0.1 percent by weight |
| C = | 0-0.2 percent by weight |
| B = | 0.011-0.3 percent by weight |

-continued

| | |
|---|---|
| $Y_2O_3$ = | 1-2 percent by weight |
| Ni = | Remainder. |

10. An oxide-dispersion-hardened superalloy as claimed in claim 9, which contains boron in a content of 0.011 to 0.1 percent by weight.

11. An oxide-dispersion-hardened superalloy as claimed in claim 9, which consists essentially of:

| | |
|---|---|
| Cr = | 13-17 percent by weight |
| Al = | 2.5-7 percent by weight |
| Mo = | 1-1.7 percent by weight |
| W = | 2.5-3.4 percent by weight |
| Ta = | 0-5 percent by weight |
| Ti = | 1-1.9 percent by weight |
| Zr = | 0.02-0.1 percent by weight |
| C = | 0-0.2 percent by weight |
| B = | 0.011-0.3 percent by weight |
| $Y_2O_3$ = | 1-2 percent by weight |
| Ni = | Remainder. |

12. An oxide-dispersion-hardened superalloy as claimed in claim 11, which contains boron in a content of 0.011 to 0.1 percent by weight.

13. An oxide-dispersion-hardened superalloy as claimed in claim 11, which consists essentially of:

| | |
|---|---|
| Cr = | 15 percent by weight |
| Al = | 5 percent by weight |
| Mo = | 1.7 percent by weight |
| W = | 3.4 percent by weight |
| Ta = | 4.5 percent by weight |
| Ti = | 1.9 percent by weight |
| Zr = | 0.1 percent by weight |
| C = | 0.05 percent by weight |
| B = | 0.011-0.3 percent by weight |
| $Y_2O_3$ = | 1.1 percent by weight |
| Ni = | Remainder. |

14. An oxide-dispersion-hardened superalloy as claimed in claim 13, which contains boron in a content of 0.011 to 0.1 percent by weight.

15. The oxide-dispersion-hardened superalloy of claim 1, wherein $\Delta T$ (recrystallization temperature minus solidus temperature) is at least 140° C.

16. The oxide-dispersion-hardened superalloy of claim 3, wherein $\Delta T$ (recrystallization temperature minus solidus temperature) is at least 140° C.

17. The oxide-dispersion-hardened superalloy of claim 5, wherein $\Delta T$ (recrystallization temperature minus solidus temperature) is at least 140° C.

18. The oxide-dispersion-hardened superalloy of claim 9, wherein $\Delta T$ (recrystallization temperature minus solidus temperature) is at least 140° C.

19. The oxide-dispersion-hardened superalloy of claim 11, wherein $\Delta T$ (recrystallization temperature minus solidus temperature) is at least 140° C.

* * * * *